US009756995B2

(12) United States Patent
Bryant

(10) Patent No.: US 9,756,995 B2
(45) Date of Patent: Sep. 12, 2017

(54) REDUCED STRAIN TOILET SEAT

(71) Applicant: Julie Windle Bryant, Longwood, FL (US)

(72) Inventor: Julie Windle Bryant, Longwood, FL (US)

( * ) Notice: Subject to any disclaimer, the term of this patent is extended or adjusted under 35 U.S.C. 154(b) by 0 days.

(21) Appl. No.: 15/385,975

(22) Filed: Dec. 21, 2016

(65) Prior Publication Data

US 2017/0100005 A1 Apr. 13, 2017

Related U.S. Application Data

(63) Continuation-in-part of application No. 11/553,088, filed on Oct. 26, 2006, now abandoned.

(60) Provisional application No. 60/731,590, filed on Oct. 28, 2005.

(51) Int. Cl.
*A47K 13/24* (2006.01)
*A47K 13/02* (2006.01)

(52) U.S. Cl.
CPC ..... *A47K 13/24* (2013.01); *A47K 13/02* (2013.01)

(58) Field of Classification Search
CPC ..... A47K 13/24; A47K 13/02
USPC ..... 4/237, 245.6, 245.7
See application file for complete search history.

(56) References Cited

U.S. PATENT DOCUMENTS

| | | | |
|---|---|---|---|
| 3,863,277 | A | 2/1975 | Harrison |
| 5,991,935 | A | 11/1999 | Wang |
| 6,370,704 | B1 | 4/2002 | White, Jr. |
| 6,815,379 | B2 | 11/2004 | Nomura |
| D556,306 | S | 11/2007 | Bryant |

FOREIGN PATENT DOCUMENTS

| | | | |
|---|---|---|---|
| JP | 2000107080 | A | 4/2000 |
| WO | 2005102134 | A1 | 11/2005 |
| WO | 2008/057186 | | 5/2008 |

*Primary Examiner* — Tuan N Nguyen
(74) *Attorney, Agent, or Firm* — Larson & Larson, P.A.; Frank Liebenow

(57) ABSTRACT

A toilet seat is includes a core with a centrally located aperture disposed therein, sized for receiving and supporting a weight of a human in a seated position for use as a toilet seat. The core is made of a solid material. A cover is affixed to the core at bottom edges of the core forming a gap between the cover and the top surface of the core, between the cover and the side surface of the core, and between the cover and the inside surface of the core. Gel is disposed in the gap, thereby providing a cushioned interface between the core and the human situated upon the cover.

16 Claims, 2 Drawing Sheets

REDUCED STRAIN TOILET SEAT

CROSS-REFERENCE TO RELATED APPLICATION

This application claims priority from U.S. provisional application Ser. No. 60/731,590 filed Oct. 28, 2005, the disclosure of which is hereby incorporated by reference. This application is a continuation-in-part of U.S. patent application Ser. No. 11/553,088 filed Oct. 26, 2006.

FIELD OF THE INVENTION

This invention relates generally to toilets and more particularly with a toilet seat that reduces strain and improves comfort.

BACKGROUND OF THE INVENTION

Cushioned toilet seats have been known and used for many years. Cushioned toilet seats evolved from the basic hard-surfaced toilet seats in an effort to improve comfort for those individuals that require extended time moving their bowels and emptying their bladder. Additionally, both hard-surfaced and presently available cushioned toilet seats are generally unsatisfactory for use by a disabled person, in that they do not accommodate perineal cleaning that may take several hours, especially for those having spinal cord injuries which seriously limits or prevents leg movement.

In the current cushioned toilet seat art, the cushion material is made of polyurethane foam encapsulated in a layer of soft plastic, such as polyvinyl chloride. These cushioned toilet seats also have a stiff supporting base, on which the cushion material rests.

For example, U.S. Pat. No. 4,248,646 to Ginsburg describes a method of making a foam filled cushioned toilet seat. As described, a foamable polyurethane resin reaction mixture is introduced into a soft plastic cover, to become the interior of the toilet seat. The resulting polyurethane foam provides for the cushioning.

U.S. Pat. No. 4,964,179 to Kimes describes a toilet seat for disabled persons. The described seat is elevated to raise the seating height and is shaped to provide different support points, but has a hard seat surface. Prolonged sitting on such a seat may cause discomfort, fatigue and even sores.

U.S. Pat. No. 6,370,704 to White, Jr. describes a fluid-cell toilet seat. The toilet seat described in this patent has a plurality of water cells disposed radially between its top cover and base. These radial cells provide some cushioning, but since they are not interfaced together, they do not allow a shift in liquid from a point of pressure to another area of the seat, thereby providing little advantage over foam. Furthermore, during extended sitting, the bumps created by the water cells may become uncomfortable.

What is needed is a toilet seat that provides improved comfort and health benefits.

SUMMARY OF THE INVENTION

In one embodiment, a toilet seat is disclosed including a core made of a solid material. The core has a top surface, a bottom surface, an outer side surface and a central aperture defining an inner side surface. Ends of a cover are attached to edges of the bottom surface of the core and a gap is formed between the outer side of the core and the cover, between the inner side of the core and the cover, and between the top surface of the core and the cover. Gel fills the gap, maintaining the shape of the cover at rest. As the gel displaces under pressure at one location, moving into the gap at another location, thereby increasing pressure exerted on the cover in that location.

In another embodiment, a toilet seat is disclosed including a core made of a solid material. The core has a top surface, a bottom surface, an outer side surface and a central aperture defining an inner side surface. Ends of a cover are attached to edges of the bottom surface of the core to form a gap between the outer side of the core and the cover, between the inner side of the core and the cover, and between the top surface of the core and the cover. The gap is filled with gel, maintaining the shape of the cover at rest. An outer edge of the toilet seat substantially forms an outer shape with a flattened tank-facing edge (the edge closest to the tank when the toilet seat is mounted to a toilet), two flattened side edges opposing each other, and an arced front edge, the arced front edge opposing the flattened tank-facing edge.

In another embodiment, a toilet seat is disclosed including a core made of a solid material and sized to fit on a toilet, the core has a top surface, a bottom surface, an outer side surface and a central aperture. The central aperture defines an inner side surface of the core. The toilet seat includes gel covering the top surface of the core, covering the outer side of the core and covering the inner side of the core with a cover that covers the gel. Ends of the cover are attached to edges of the bottom surface of the core. The gel maintains the shape of the cover at rest. An outer edge of the toilet seat substantially forms an outer shape with a flattened tank-facing edge, two flattened side edges opposing each other, and an arced front edge, the arced front edge opposing the flattened tank-facing edge.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
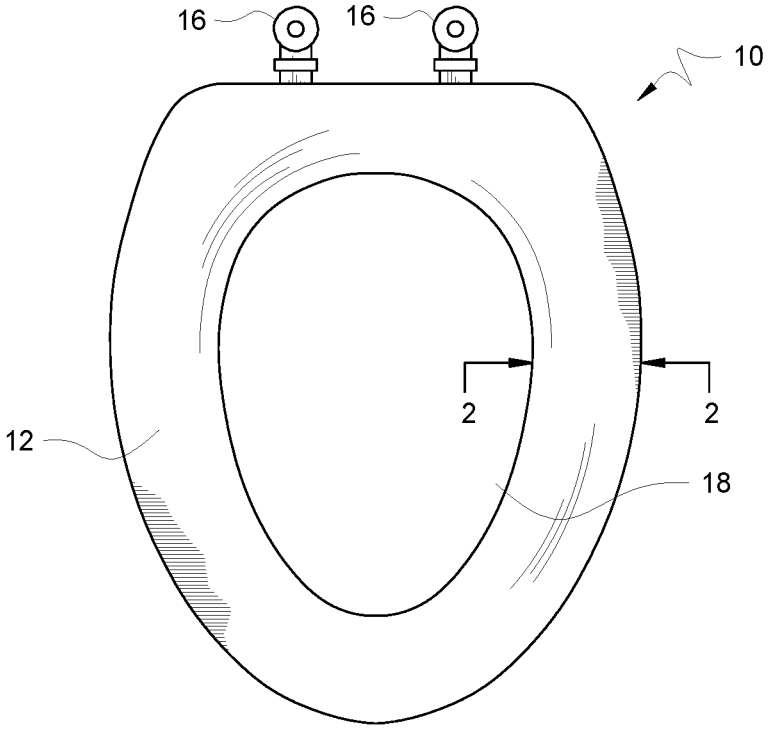
FIG. 1 (Prior Art)
FIG. 1 illustrates a top view of the prior art.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a top view of a toilet seat of the prior art is shown. Many toilet seats of the prior art are shaped as the seat 10, though some are more oblong and some have a void towards the front (somewhat of an inverted "U"). Most seats of the prior art are hinged and fasten by a standard arrangement using two bolts (not shown) passing through the end fittings 16 of the hinges. Generally, toilet seats of the prior art have a centrally located aperture 18 and a seat area 12.

Figure 2:
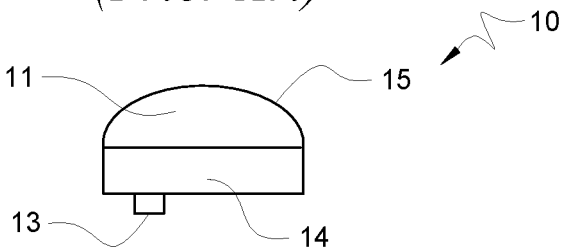
FIG. 2 (Prior Art)
FIG. 2 illustrates a cross-sectional view along line 2-2 of the prior art.

Referring to FIG. 2, a cross-sectional view along line 2-2 of a toilet seat of the prior art is shown. Although many toilet seats 10 of the prior art consist of a solid seat member, though some toilet seats 10 of the prior art include a solid base 14 and a vinyl or plastic cover 15 and are filled with a foam 11 such as polyurethane foam between the solid base 14 and the plastic cover 15. Such foam 11 provides a small amount of cushioning but does not provide enough of a cushion for long periods of use. Also shown is a standoff 13 that holds the toilet seat 10 a small distance above the toilet bowl (not shown).

Figure 3:
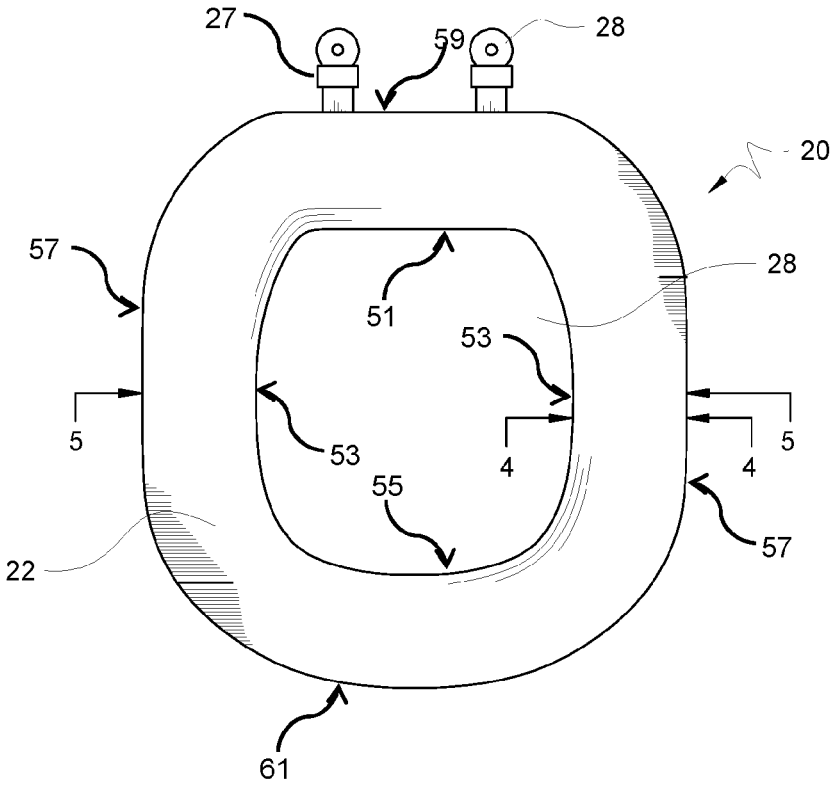
FIG. 3 illustrates a top view of the present invention.
Figure 4:
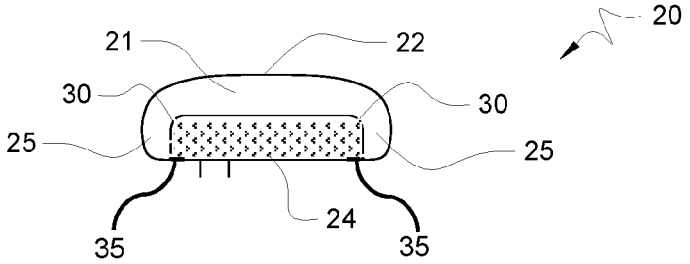
FIG. 4 illustrates a cross-sectional view along line 4-4 of the present invention.

Referring to FIGS. 3 and 4, a top view and cross sectional view of the present invention is shown. In some embodiments, the toilet seat 20 of the present invention is shaped as shown in FIG. 3. In this, the tank-facing edge 59 is substantially flat and the inside tank-facing edge 51 is also substantially flat, as shown. In some embodiments the tank facing edge 59 has hinges 27 and fastens by a standard arrangement using two bolts (not shown) passing through the end fittings 28 of the hinges. The toilet seat 20 has a centrally located aperture 29 and a cover 22. The centrally located aperture 29 is open sufficiently to pass waste into a toilet bowl.

In the example shown, the outer side edges 57 are flattened and the inside side edges are slightly curved, while the front edge 61 (opposing the tank-facing edge) and inside front edge 55 are shaped as an arc.

In the cross section shown in FIG. 4, the cover 22 of the toilet seat 20 is attached to a core 24 at outer bottom edges of the core 24, creating a gap which is filled with gel 21/25. As shown, the cover 22 of the toilet seat 20 is attached to a core 24 at attach points 35, for example, using fasteners, staples, adhesive, etc. The core 24 is made of a solid material.

There are many materials anticipated for filling the core 24, all suitable for comfort and medical cushioning of humans. The preferred gel 21/25 has the consistency of fatty tissue. It can "slide" and move laterally, so they are effective in balancing and shifting forces. Examples of the gel 21/25 include, for example, polyurethane gels, polyurethane elastomeric gels, elastomeric gels, silicone gels, silicone dielectric gels, neoprene impregnated with nitrogen bubbles, etc or any combination of the like. One such gel 21/25 is Gelastic™ as described in U.S. Pat. No. 5,994,450 to Pearce issued Nov. 30, 1999, which is hereby incorporated by reference. This material is an oil-extended tri-block copolymer elastomeric gel. The gel 21/25 is anticipated to be formed by extrusion, casting, or injection molding. Because the softness is controlled by oil content, the gel 21/25 is made in a wide range of hardness/softness and is very strong and durable.

Another anticipated solid gel 21/25 is Intelli-Gel™ described in U.S. Pat. No. 6,026,527 to Pearce issued Feb. 22, 2000 and U.S. Pat. No. 5,749,111 to Pearce issued May 12, 1998, both of which are hereby incorporated by reference.

Gel 21 is positioned between the cover 22 at the top surface of the toilet seat 20 (e.g. the portion of the cover 22 that contacts the user's buttocks) and the core 24. In operation, as a person sits on the toilet seat 20, more force is exerted at locations of the person's buttocks that are bony (e.g., pelvic areas). In contrast to seats of the prior art which simply deform in those bony areas, instead, as the gel 25 is displaced from the force of the bony areas, increase pressure is exerted on other areas of the seat 20, for example, areas of the cover 20 that hold soft tissue, thereby increasing the pressure exerted back by the toilet seat 20 in areas supporting soft tissue, providing enhanced comfort to the person using the toilet seat 20.

Gel 25 is positioned between the inner edges 51/53/55 of the cover 22 and the core 24 and between the outer edges 57/59/61 of the cover 22 and the core 24, providing extra cushioning for any part of the human body that may overlap the inner edges 51/53/55 or the outer edges 57/59/61. This provides similar comfort to any part of the user's buttocks that laps over the inner edges 51/53/55 and the outer edges 57/59/61.

In some embodiments, a standoff 23 is affixed to the bottom of the toilet seat 20 and is intended to rest on the toilet bowl (not shown) to raise the toilet seat 20 from the toilet bowl. In some embodiments, the upper corners 30 of the core 24 are rounded for improved comfort.

The top cover 22 is made of a durable, flexible, soft material such as vinyl, woven cloth, leather, synthetic leather, rubber, plastic film or the like. For medical use, especially in situations where the patient remains on the seat 20 for extended periods of time, the top cover 22 is made of a material that has antibacterial properties. One example of an antibacterial cloth can be found in U.S. Pat. No. 6,815,379 to Nomura, issued Nov. 9, 2004. This patent describes a cloth comprising glass which is generally a soluble glass and a gold component is contained in a glass composition, thereby reducing bacterial growth. Other known antibacterial cloths include silver threads to reduce bacterial growth.

Another example of an antimicrobial fabric is described in U.S. Pat. No. 6,979,491 to Yan, et al., issued Dec. 27, 2005, which is hereby incorporated by reference. The described fabric produces an antimicrobial and antifungal effect by the use of nanosilver particles that adhere to the fabric.

In another embodiment of the present invention, a neoprene material such as G231 is used for the top cover 22, which is a closed cellular product made from neoprene, typically used for scuba diving wetsuits. This type of material allows some gases to permeate the top cover 22, while preventing moisture from collecting, thereby reducing bacterial growth.

Figure 5:
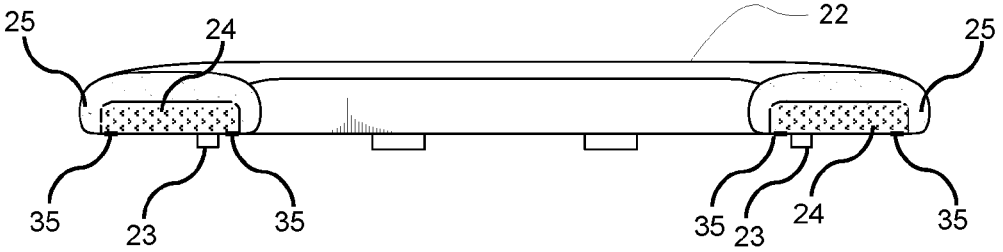
FIG. 5 illustrates a cross-sectional view along line 5-5 of the present invention.

Referring to FIG. 5, a cross-sectional view along line 5-5 of the present invention is shown. FIG. 5 shows a complete cross-section of the toilet seat 20 of the present invention.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A toilet seat comprising:

a core made of a solid material, the core having a top surface, a bottom surface, an outer side surface and a central aperture defining an inner side surface of the core;

a cover, ends of the cover are attached to edges of the bottom surface of the core, a gap is formed between the outer side of the core and the cover, between the inner side of the core and the cover, and between the top surface of the core and the cover; and gel fills the gap, the gel maintaining the shape of the cover at rest;

whereas the gel displaces under pressure at one location, the gel that is displaced moving into the gap at another location, thereby increasing pressure exerted on the cover in the another location.

2. The toilet seat of claim 1, wherein a tank-facing edge of the toilet seat and an inside tank-facing edge of the toilet seat is substantially flat.

3. The toilet seat of claim 2, wherein outer side edges of the toilet seat are flattened, the inside side edges of the aperture are slightly curved and a front edge and inside front edge are shaped as an arc, the front edge opposing the tank-facing edge.

4. The toilet seat of claim 1, wherein the cover is made from a sheet of material selected from the group consisting of vinyl, woven cloth, leather, synthetic leather, rubber and plastic film.

5. The toilet seat of claim 1, wherein the cover is made from a sheet of antimicrobial fabric.

6. The toilet seat of claim 1, wherein the gel comprises an elastomeric gel.

7. A toilet seat comprising:

a core made of a solid material, the core having a top surface, a bottom surface, an outer side surface and a central aperture defining an inner side surface of the core;

a cover, ends of the cover are attached to edges of the bottom surface of the core, a gap is formed between the outer side of the core and the cover, between the inner side of the core and the cover, and between the top surface of the core and the cover; and gel fills the gap, whereas the gel maintains the shape of the cover at rest;

wherein an outer edge of the toilet seat substantially forms an outer shape with a flattened tank-facing edge, two flattened side edges opposing each other, and an arced front edge, the arced front edge opposing the flattened tank-facing edge.

8. The toilet seat of claim 7, wherein the centrally located aperture has a substantially flat inside tank-facing edge, two flattened inside edges opposing each other, and an arced inside front edge, the arced front edge opposing the substantially flat inside tank-facing edge.

9. The toilet seat of claim 7, wherein the cover is made from a sheet of antimicrobial fabric.

10. The toilet seat of claim 9, wherein the gel comprises an elastomeric gel.

11. The toilet seat of claim 9, whereas the gel displaces under pressure at one location, moving into the gap at another location, thereby increasing pressure exerted on the cover in the another location.

12. A toilet seat comprising:

a core made of a solid material and sized to fit on a toilet, the core having a top surface, a bottom surface, an outer side surface and a central aperture, the central aperture defining an inner side surface of the core;

gel, the gel covering the top surface of the core, covering the outer side of the core and covering the inner side of the core; and a cover, ends of the cover are attached to edges of the bottom surface of the core, the cover encloses the gel; and whereas the gel maintaining the shape of the cover at rest;

wherein an outer edge of the toilet seat substantially forms an outer shape with a flattened tank-facing edge, two flattened side edges opposing each other, and an arced front edge, the arced front edge opposing the flattened tank-facing edge.

13. The toilet seat of claim 12, wherein the centrally located aperture has a substantially flat inside tank-facing edge, two flattened inside edges opposing each other, and an arced inside front edge, the arced front edge opposing the substantially flat inside tank-facing edge.

14. The toilet seat of claim 12, wherein the cover is made from a sheet of antimicrobial fabric.

15. The toilet seat of claim 12, wherein the gel comprises an elastomeric gel.

16. The toilet seat of claim 12, whereas the gel displaces under pressure at one location, moving into the gap at another location, thereby increasing pressure exerted on the cover in the another location.

* * * * *